United States Patent [19]

Meyer

[11] Patent Number: 4,747,890

[45] Date of Patent: May 31, 1988

[54] AL-BASE ALLOY HOLLOW BODIES UNDER PRESSURE

[75] Inventor: Philippe Meyer, Voiron, France

[73] Assignee: Societe Metallurgieque de Gerzat, Paris, France

[21] Appl. No.: 911,067

[22] Filed: Sep. 24, 1986

[30] Foreign Application Priority Data

Jul. 24, 1986 [FR] France ..... 86 10930

[51] Int. Cl.[4] ..... C22C 21/10

[52] U.S. Cl. ..... 148/439; 420/532

[58] Field of Search ..... 420/532; 148/417, 439

[56] References Cited

U.S. PATENT DOCUMENTS 3,198,676 8/1965 Sprowls et al. ..... 148/417
3,791,876 2/1974 Kroger ..... 148/2
4,410,370 10/1983 Baba et al. ..... 148/439

FOREIGN PATENT DOCUMENTS 81441 10/1985 European Pat. Off. .
855809 3/1940 France .
860724 1/1941 France .
867770 11/1941 France .

*Primary Examiner*—R. Dean
*Attorney, Agent, or Firm*—Dennison, Meserole, Pollack & Scheiner

[57] ABSTRACT

The invention relates to hollow bodies for gas under pressure manufactured from an aluminum alloy containing Zn, Cu and Mg as principal alloying elements and intended in particular for the production of metal bottles for pressurized gas. The hollow bodies are manufactured from an alloy consisting essentially of (in % by weight):

| | |
|---|---|
| 6.25 ≦ Zn ≦ 8.0 | Mn ≦ 0.20 |
| 1.2 ≦ Mg ≦ 1.95 | Zr ≦ 0.05 |
| 1.7 ≦ Cu ≦ 2.8 | Ti ≦ 0.05 |
| 0.15 ≦ Cr ≦ 0.28 | Others each ≦0.05 |
| Fe ≦ 0.20 | Others total ≦0.15 |
| Si + Fe ≦ 0.40 | Balance Al. |

The alloy in state T73 complies with the very severe technical requirements in respect of strength and ductility which are imposed in relation to use for hollow bodies under pressure.

4 Claims, 2 Drawing Sheets

AL-BASE ALLOY HOLLOW BODIES UNDER PRESSURE

The invention relates to an Al alloy for hollow bodies under pressure, containing Zn, Cu and Mg as principal alloying elements (series 7000 using the Aluminium Association designations) and intended in particular for the production of metal bottles for pressurised gas.

Hitherto none of the known high-strength Al alloys has been capable of reliably and reproducibly satisfying the severe technical requirements which are imposed by the last-mentioned application and which are as follows:

| | | |
|---|---|---|
| Mechanical characteristics: (long direction) | Rp 0.2 | ≧ 370 MPa |
| | Rm | ≧ 460 MPa |
| | A % | ≧ 12% |

Resistance to stress crack corrosion, under 75% of R 0.2 guaranteed, that is to say, 280 MPa, a period of greater than 30 days involving alternate immersion and emersion for 10 min/50 min in an aqueous 3.5% NaCl solution at ambient temperature on a testpiece in C under the conditions defined in the standard ASTM G-38-73 (re-approved in 1984)

Ductile splitting of the hollow body of cylindrical shape following a hydraulic bursting test using water; the split:

must be longitudinal in its major part (parallel to the generatrices)

must not be of a branched configuration must not extend by more than 90° on respective sides of the main part of the split must not extend into a part of the body whose thickness exceeds 1.5 times the maximum thickness as measured at the middle of the body.

Attempts have been made to solve that problem by using an alloy of type 7475 (using the Aluminium Association nomenclature) but that alloy has been found not to be a viable proposition when subjected to extended industrial tests (see FR-A-2 510 231), that being the situation in spite of its very high level of toughness, its good mechanical strength and its remarkable resistance to stress crack corrosion in the state T73.

The difficult problem indicated above is solved according to the invention by using an alloy of the following composition (in % by weight):

| | | | |
|---|---|---|---|
| 6.25 ≦ | Zn | ≦ 8.0 | Mn ≦ 0.20 |
| 1.2 ≦ | Mg | ≦ 2.2 | Zr ≦ 0.05 |
| 1.7 ≦ | Cu | ≦ 2.8 | Ti ≦ 0.05 |
| 0.15 ≦ | Cr | ≦ 0.28 | Others each ≦ 0.05 |
| | Fe | ≦ 0.20 | Others total ≦ 0.15 |
| Fe + Si | | ≦ 0.40 | Balance Al |

The proportions involved are preferably kept within the following ranges, individually or in combination:

| | | |
|---|---|---|
| Zn ≧ 6.75 | | Mg ≦ 1.95 |
| Fe ≦ 0.12 | Fe + Si ≦ 0.25 | Mn ≦ 0.10 |

The alloys according to the invention can be cast by means of conventional processes such as semi-continuous casting and the characteristics required in respect of the gas bottles are met.

Figure 1:
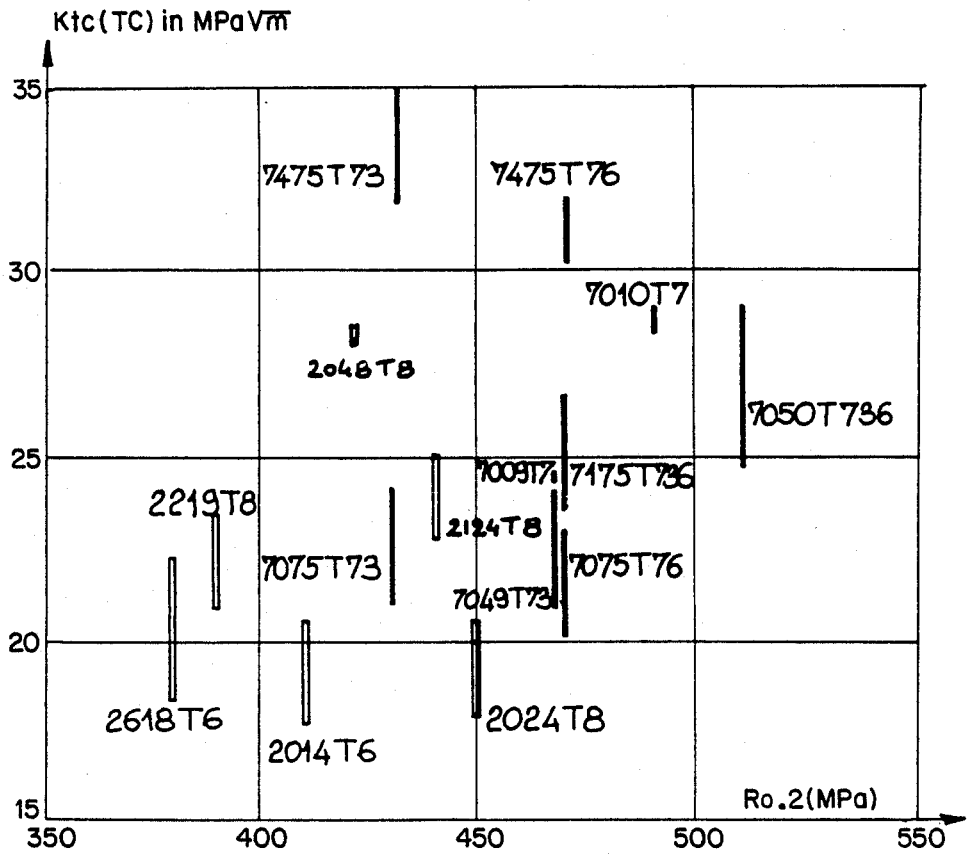
Figure 2:
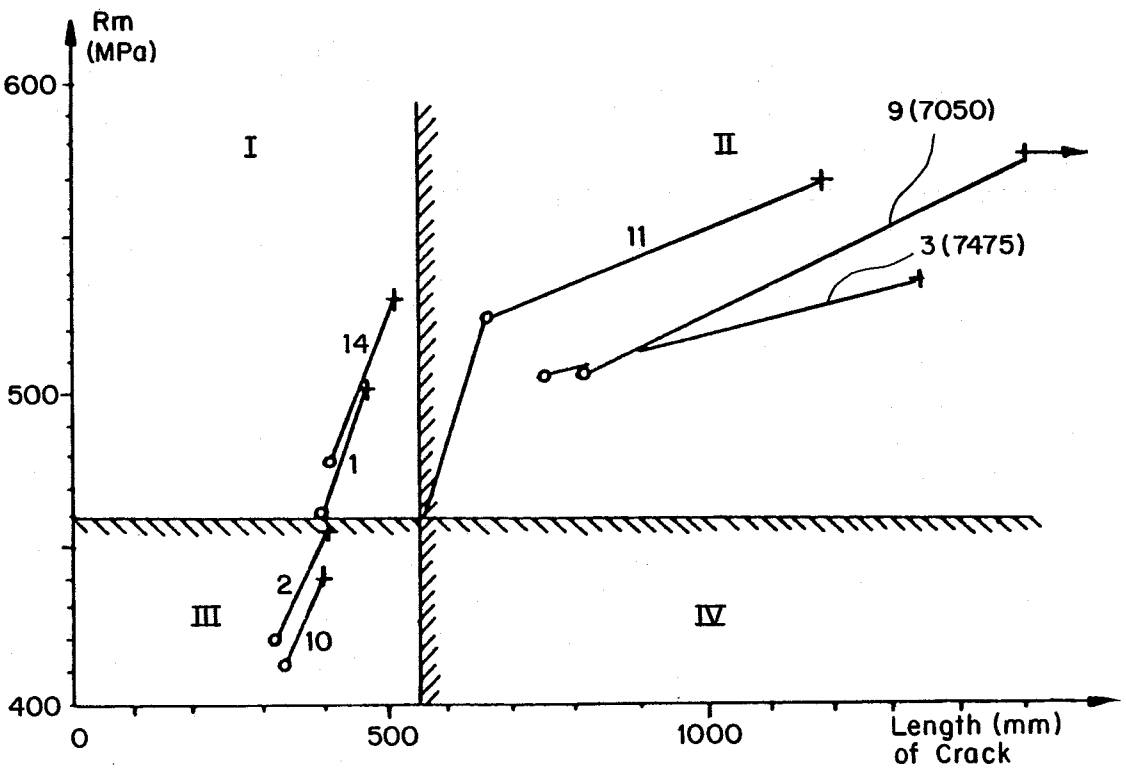

The invention will be better appreciated by reference to the following Examples which are illustrated in FIGS. 1 and 2.

FIG. 1 shows the compromise in respect of elastic limit and toughness ($K_{1C}$ in the short transverse direction) of known high-strength Al alloys which are resistant to stress corrosion, and FIG. 2 shows the results of the characteristics in respect of breaking strain (Rm) and length of cracking in carrying out bursting tests on bottles for various alloys.

EXAMPLE No 1

(outside the invention—FIG. 1)

Alloys 7475 whose chemical compositions are set forth in Table I were prepared and converted into 6 liter bottles, using the manufacturing procedure set forth below:

Casting billets of $\phi$ 164.5 mm in a semi-continuous casting operation
Sawing off portions
Reheating the portions
Reverse extrusion of cases
Hot and cold drawing operations
Machining the bottom
Cutting to length
Forming a conically pointed portion by hot working
Piercing the neck and machining
Cleaning off
Solution treatment
Quenching with cold water
Annealing of type T73.

The results of tests in respect of tensile strength in the long direction (average of 6 testpieces×2 bottles), stress crack corrosion (1 bottle) and hydraulic bursting (3 bottles) are set forth in Table II.

The unstable performance of that alloy, in particular as regards the aspect of splitting, may be noted. That composition is therefore not suitable for dependable industrial production, in spite of its good compromise in respect of toughness and mechanical strength.

EXAMPLE No 2

7 alloys, the compositions of which are set forth in Table III, were cast in the form of billets; they were converted into 6 liter bottles (total height: 565 mm; external $\phi$: 152 mm; internal $\phi$: 127 mm), using the manufacturing procedure similar to that set forth in Example 1, except as regards the annealing operation. Two of the alloys (references 1 and 14) are in accordance with the invention while the others are outside the invention.

Three annealing operations were carried out:

$R_1$—6 h 105° C.+5 h 30 177° C. (over-annealing not very advanced)

$R_2$—6 h 105° C.+9 h 177° C. (seriously over-annealed)

$R_3$—6 h 105° C.+24 h 177° C. (very severely over-annealed, in one case)

The results of tests in respect of mechanical characteristics (lengthwise direction) and bursting tests are set forth in Table IV. It can be seen that only the compositions according to the invention make it possible to satisfy all the technical requirements.

The castings referenced 1 and 14 also have a good level of resistance to stress corrosion (no rupture in 30 days under the conditions indicated).

The mean lengths of the cracks which developed in the 3 test bottles per case are set forth in Table V.

FIG. 2 shows that only the alloys according to the invention make it possible to meet all the criteria imposed.

Zone I corresponds to an acceptable level of performance in regard to bursting, with satisfactory mechanical characteristics.

Zone II corresponds to satisfactory mechanical characteristics but poor level of performance in respect of bursting.

Zone III corresponds to unsatisfactory mechanical characteristics and a good level of performance in regard to bursting.

Zone IV corresponds to unsatisfactory mechanical characteristics and a poor level of performance in regard to bursting.

TABLE I

| | composition of 7475 (% by weight) | | | | | | |
|---|---|---|---|---|---|---|---|
| | Fe | Si | Cu | Mg | Zn | Cr | Remarks |
| A | 0.10 | 0.06 | 1.45 | 2.20 | 5.60 | 0.20 | repetitions |
| B | 0.11 | 0.06 | 1.43 | 2.16 | 5.40 | 0.22 | |
| C | 0.11 | 0.05 | 1.44 | 2.20 | 5.40 | 0.21 | |
| D | 0.10 | 0.06 | 1.44 | 2.20 | 5.56 | 0.20 | |
| E | 0.05 | 0.03 | 1.32 | 2.36 | 5.70 | 0.21 | Purer base |

TABLE II

| | Results of tests on 7475 T73 | | | | | |
|---|---|---|---|---|---|---|
| Ref. | R0.2 | Rm | A % | Bursting aspect | Bursting pressure (MPa) | SC* 280 MPa |
| A | 392 | 462 | 14.1 | good | 87 | NR to 30 d |
| | | | | good | 86 | |
| | | | | good | 87 | |
| B | 386 | 460 | 14.3 | poor | 87.2 | NR to 30 d |
| | | | | poor | 87.2 | |
| | | | | poor | 86 | |
| C | 395 | 464 | 15.0 | poor | 87.6 | NR to 30 d |
| | | | | good | 88 | |
| | | | | poor | 88 | |
| D | 396 | 464 | 14.1 | good | 88 | NR to 30 d |
| | | | | poor | 88 | |
| | | | | good | 88 | |
| E | 411 | 480 | 15.2 | good | 89.2 | NR to 30 d |
| | | | | good | 90 | |
| | | | | poor | 89 | |

*SC = stress corrosion
NR = no rupture

TABLE III

| | Chemical compositions (% by weight) | | | | | | |
|---|---|---|---|---|---|---|---|
| Ref.* | Cu | Mg | Zn | Fe | Si | Cr | Ti |
| 1 (a) | 1.70 | 1.75 | 7.00 | 0.04 | 0.04 | 0.20 | <0.02 |
| 14 (a) | 2.40 | 1.85 | 7.00 | 0.04 | 0.03 | 0.20 | 0.02 |
| 2 (b) | 1.20 | 1.35 | 6.00 | 0.03 | 0.04 | 0.20 | 0.02 |
| 3 (7475) (b) | 1.30 | 2.50 | 6.00 | 0.04 | 0.03 | 0.21 | 0.02 |
| 9 (7050 (b) with Cr) | 2.25 | 2.35 | 6.10 | 0.05 | 0.03 | 0.19 | 0.02 |
| 10 (b) | 2.20 | 1.10 | 8.00 | 0.03 | 0.03 | 0.20 | <0.02 |
| 11 (b) | 2.20 | 2.40 | 8.00 | 0.05 | 0.04 | 0.10 | 0.02 |

*(a) according to the invention
(b) outside the invention

TABLE IV

| | CHARACTERISATION OF THE BOTTLES | | | | | | | | | | | |
|---|---|---|---|---|---|---|---|---|---|---|---|---|
| | 6 h 105° + 5 h 30 177° | | | | 6 h 105° + 9 h 177° | | | | 6 h 105° + 24 h 177° | | | |
| Refs. | Rm (MPa) | R0.2 (MPa) | A % | E* | Rm (MPa) | R0.2 (MPa) | A % | E* | Rm (MPa) | R0.2 (MPa) | A % | E* |
| 1(a) | 504 | 466 | 14.8 | G | 460 | 395 | 16.7 | G | | — | | |
| 14(a) | 530 | 480 | 14.3 | G | 479 | 403 | 15.4 | G | | — | | |
| 2(b) | 458 | 415 | 15.6 | G | 420 | 353 | 16.0 | G | | — | | |
| 3(b) | 538 | 500 | 13.6 | P | 508 | 458 | 14.5 | P | | — | | |
| 9(b) | 581 | 544 | 13.6 | P | 532 | 478 | 14.7 | P | | — | | |
| 10(b) | 442 | 406 | 15.5 | G | 411 | 342 | 16.1 | G | | — | | |
| 11(b) | 570 | 525 | 13.5 | P | 525 | 462 | 14.7 | P | 462 | 400 | 15 | ** |

*Burstings (3 bottles): G Good; P Poor
**in this case: two good splits and one poor
(a) according to the invention
(b) outside the invention

TABLE V

| | Mean length of cracks (in mm) | | | |
|---|---|---|---|---|
| | Ref. castings | Annealing R1 | Annealing R2 | Annealing R3 |
| According to the invention | 1 | 470 | 400 | — |
| | 14 | 510 | 421 | — |
| Outside the invention | 2 | 418 | 335 | — |
| | 3 | 1330 | 876 | — |
| | 9 | ≧1500 | 778 | — |
| | 10 | 390 | 342 | — |
| | 11 | 1182 | 667 | 562 |

I claim:

1. Wrought hollow body for gas under pressure which is manufactured from an aluminum alloy consisting essentially of (in % by weight):

| | |
|---|---|
| 6.25 ≦ Zn ≦ 8.0 | Mn ≦ 0.20 |
| 1.2 ≦ Mg ≦ 1.95 | Zr ≦ 0.05 |
| 1.7 ≦ Cu ≦ 2.8 | Ti ≦ 0.05 |
| 0.15 ≦ Cr ≦ 0.28 | Others each ≦0.05 |
| Fe ≦ 0.20 | Others total ≦0.15 |
| Si + Fe ≦ 0.40 | Balance Al. |

2. An Al alloy according to claim 1 characterised in that

Zn≧6.75.

3. An alloy according to one of claims 1 or 2 characterised in that

Fe≦0.12% and Fe+Si≦0.25%.

4. An alloy according to one of claims 1 or 2 characterised in that

Mn≦0.10%.

* * * * *